US010738963B2

(12) United States Patent
Totsuka et al.

(10) Patent No.: US 10,738,963 B2
(45) Date of Patent: Aug. 11, 2020

(54) VEHICLE LAMP

(71) Applicant: Koito Manufacturing Co., Ltd., Tokyo (JP)

(72) Inventors: Takahiro Totsuka, Shizuoka (JP); Masahiro Takahashi, Shizuoka (JP); Masayuki Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 16/574,292

(22) Filed: Sep. 18, 2019

(65) Prior Publication Data

US 2020/0096169 A1 Mar. 26, 2020

(30) Foreign Application Priority Data

Sep. 21, 2018 (JP) ..... 2018-177880

(51) Int. Cl.
*F21S 45/10* (2018.01)
*F21S 43/19* (2018.01)
*F21S 43/20* (2018.01)

(52) U.S. Cl.
CPC ..... *F21S 45/10* (2018.01); *F21S 43/195* (2018.01); *F21S 43/26* (2018.01)

(58) Field of Classification Search
CPC ..... F21S 45/10; F21S 43/195; F21S 43/26
See application file for complete search history.

(56) References Cited

FOREIGN PATENT DOCUMENTS

JP 2012-064500 A 3/2012
JP 2019033040 A * 8/2017

* cited by examiner

*Primary Examiner* — Joseph L Williams
*Assistant Examiner* — Jose M Diaz
(74) *Attorney, Agent, or Firm* — Abelman, Frayne & Schwab

(57) ABSTRACT

A vehicle lamp includes a lamp body, a translucent cover combined with the lamp body to form a lamp chamber in between, a printed circuit board disposed in the lamp chamber and including a light emitting element mounted thereon and a ground pattern provided on the same surface as or a surface opposite to the light emitting element, and a lamp component disposed in the lamp chamber and including a base formed of an insulating member, a conductive surface provided on at least a portion of a surface of the base, and a discharge protrusion disposed on the base so as to be closer to the ground pattern than the light emitting element and covered by the conductive surface.

3 Claims, 8 Drawing Sheets

10

VEHICLE LAMP

CROSS-REFERENCE TO RELATED APPLICATIONS

This application is based on and claims priority from Japanese Patent Application No. 2018-177880, filed on Sep. 21, 2018, with the Japan Patent Office, the disclosure of which is incorporated herein in its entirety by reference.

TECHNICAL FIELD

The present disclosure relates to a vehicle lamp, and more particularly, to a vehicle lamp used in a vehicle such as an automobile.

BACKGROUND

Conventionally, for example, a component in which aluminum deposition is performed on the surface of a body formed of a resin, such as an extension, has been frequently used in a vehicle lamp (see, e.g., Japanese Patent Laid-open Publication No. 2012-064500).

SUMMARY

As a result of intensive studies on a vehicle lamp, the present inventors have come to recognize the following subject. Although the vehicle lamp includes a surface member such as a cover exposed to the external environment, the surface member is likely to cause frictional charging due to, for example, wind or sandy dust during vehicle driving. As the accumulation of charge on the surface member gradually progresses and the potential difference between the surface member and a ground potential portion (e.g., a vehicle body) expands, an electric field generated inside the vehicle lamp also becomes strong. Thus, inductive charging may be caused in components having a conductive surface in the lamp such as an extension and a reflector. When the potential difference between adjacent components exceeds a limit, electrostatic discharge occurs between the components. In the worst case, when a light emitting element is discharged, the light emitting element may be destroyed.

Due to design differentiation or other reasons, for example, a fairly long vehicle lamp such as a tail lamp that extends over substantially the entire width of the vehicle may be required. Such a long vehicle lamp may have a design in which longitudinally elongated components are disposed close to each other in a plane perpendicular to the longitudinal direction. In that case, a conductive surface on the component also extends longitudinally, thus having a relatively large area. The amount of accumulated charge also increases in proportion to the area. Therefore, the risk of electrostatic discharge to another component (e.g., a light emitting element) close to the component having the conductive surface may increase. This subject is not limited to the long vehicle lamp, and may occur with regard to other vehicle lamps.

The present disclosure has been made in view of these circumstances, and provides a vehicle lamp having a countermeasure against static electricity.

In order to solve the above subject, a vehicle lamp according to an aspect of the present disclosure includes: a lamp body; a translucent cover combined with the lamp body to form a lamp chamber in between; a printed circuit board disposed in the lamp chamber and including a light emitting element mounted thereon and a ground pattern provided on the same surface as or a surface opposite to the light emitting element; and a lamp component disposed in the lamp chamber and including a base formed of an insulating member, a conductive surface provided on at least a portion of a surface of the base, and a discharge protrusion disposed on the base so as to be closer to the ground pattern than the light emitting element and covered by the conductive surface.

According to this aspect, the discharge protrusion is used as a discharge starting point. Since the discharge protrusion is closer to the ground pattern than the light emitting element, even if electrostatic discharge occurs, the discharge is likely to be directed to the ground pattern and the risk of discharge to the light emitting element is reduced. In this way, the light emitting element may be protected from electrostatic discharge. Further, since the discharge protrusion is covered by the conductive surface on the lamp component, all or most of the charge accumulated on the conductive surface is released once the discharge occurs, whereby it is possible to eliminate or reduce charging of the lamp component.

The printed circuit board may include an insulating layer that covers the ground pattern. The discharge protrusion may come into physical contact with the printed circuit board so as to sandwich the insulating layer between the discharge protrusion and the ground pattern.

The discharge protrusion may face an insulating side surface of the printed circuit board or may come into physical contact with the insulating side surface of the printed circuit board.

According to the present disclosure, it is possible to provide a vehicle lamp having a countermeasure against static electricity.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
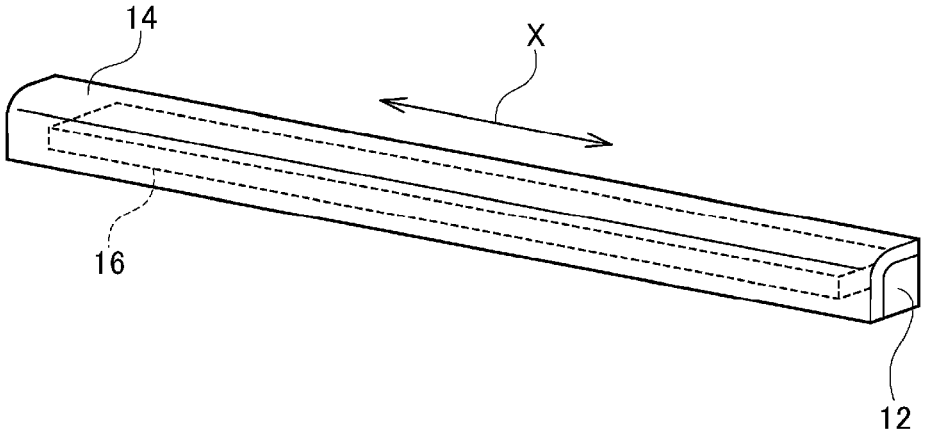
FIG. 1 is a schematic perspective view illustrating a vehicle lamp according to an embodiment.

Hereinafter, the present disclosure will be described based on exemplary embodiments with reference to the accompanying drawings. The embodiments do not limit the disclosure and are merely examples, and all features and combinations thereof described in the embodiments may not be necessarily essential to the disclosure. The same or equivalent components, members, and processings illustrated in the respective drawings are denoted by the same reference numerals, and duplicated descriptions are omitted as appropriate. Further, the scale and shape of each component illustrated in each drawing are set for convenience to facilitate the description, and unless otherwise stated, are not interpreted in a limited manner. Further, the terms "first" and "second," for example, used in the specification or the claims do not indicate any order or importance, and are used to distinguish one component from another component. Further, in each drawing, illustration of a portion of a member which is not important in describing the embodiment is omitted.

Figure 2:
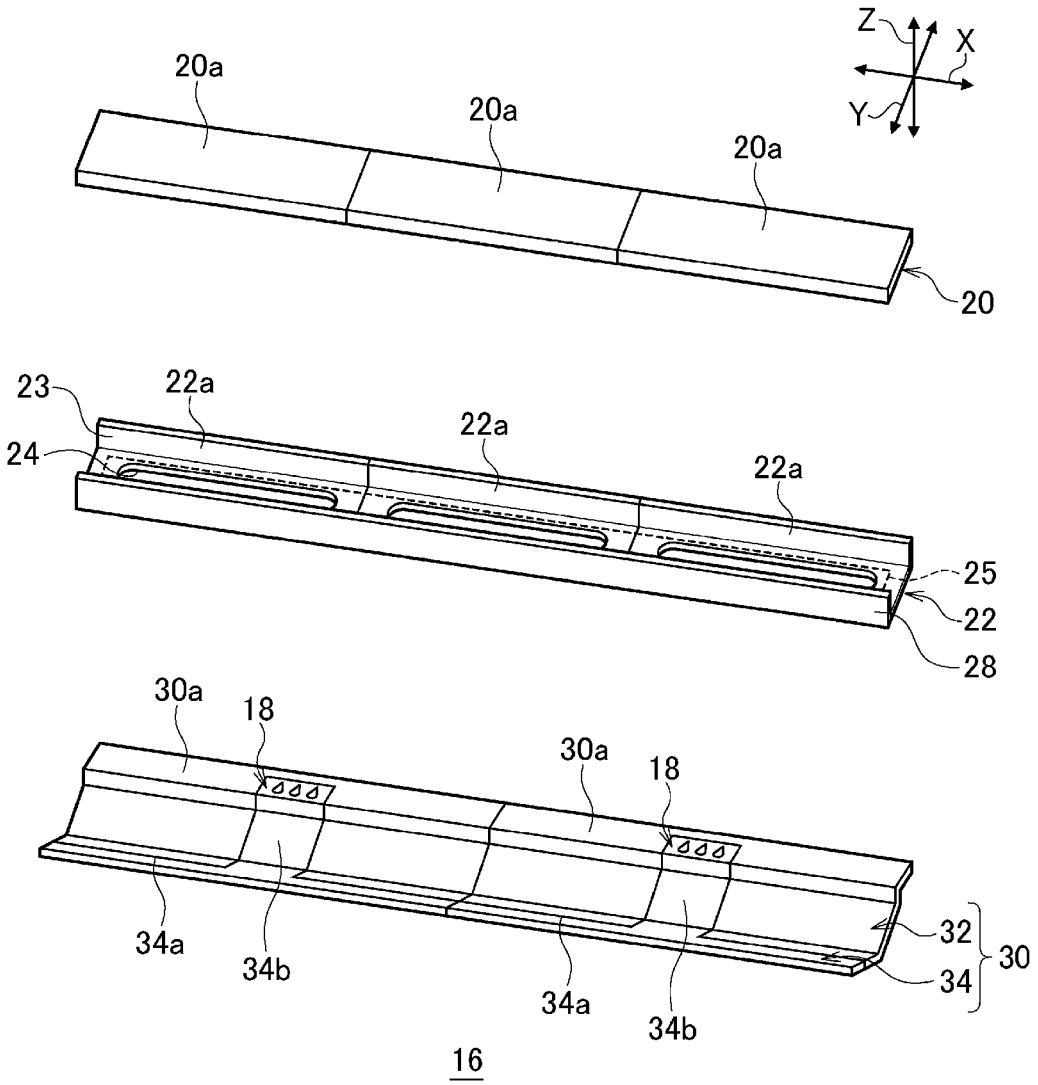
FIG. 2 is a schematic exploded perspective view illustrating a lamp unit according to the embodiment.
Figure 3:
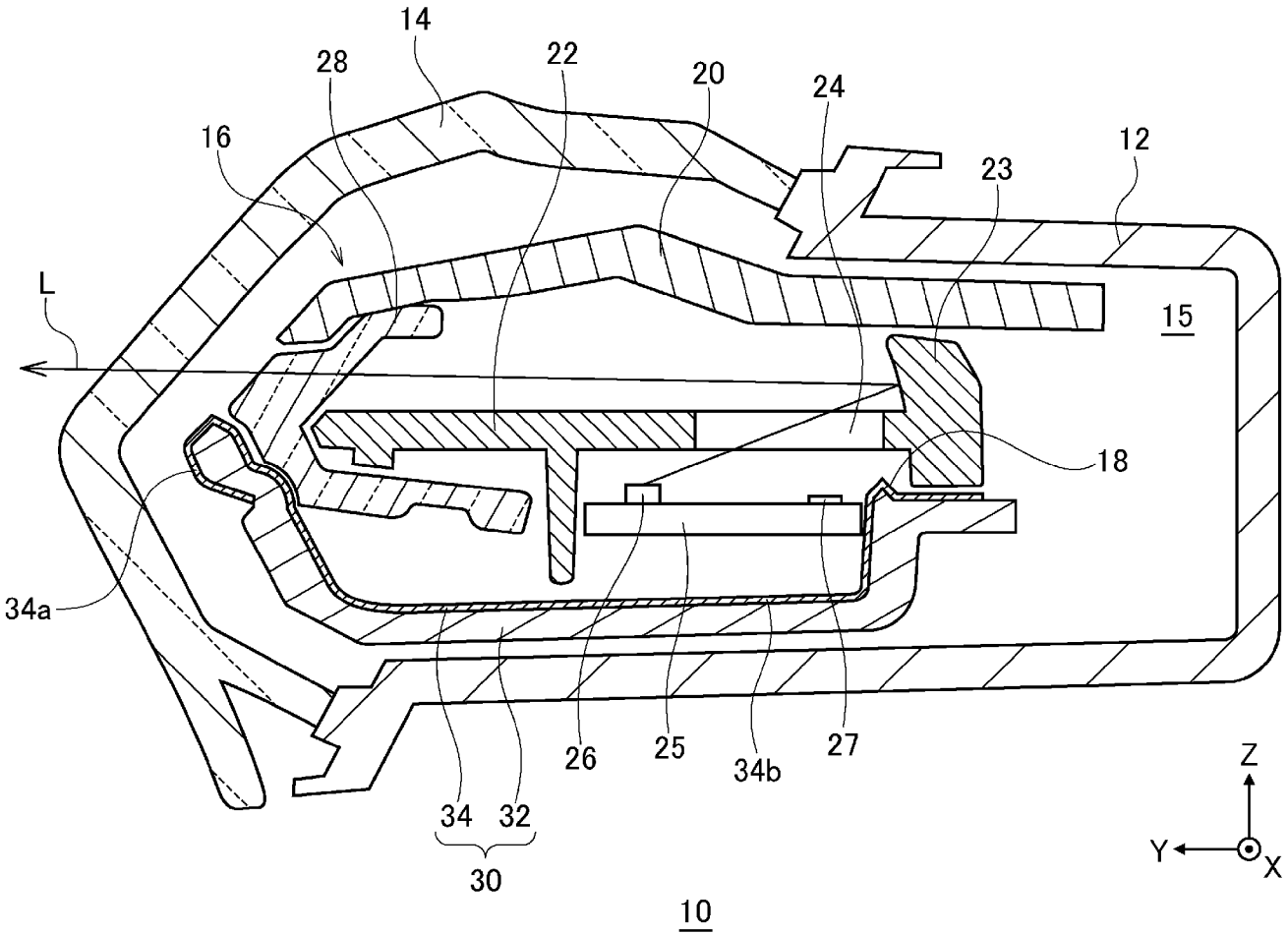
FIG. 3 is a schematic cross-sectional view of the vehicle lamp according to the embodiment.

FIG. 1 is a schematic perspective view illustrating a vehicle lamp according to an embodiment. FIG. 2 is a schematic exploded perspective view illustrating a lamp unit according to the embodiment. FIG. 3 is a schematic cross-sectional view of the vehicle lamp according to the embodiment.

As illustrated in FIGS. 1 and 3, the vehicle lamp 10 includes a lamp body 12 having an opening and a translucent cover 14 covering the opening in the lamp body 12. A lamp unit 16 is accommodated in a lamp chamber 15 formed by the lamp body 12 and the translucent cover 14. The lamp unit 16 is fixed to the lamp body 12.

The vehicle lamp 10 is, for example, a long vehicle lamp elongated along the longitudinal direction X thereof. The vehicle lamp 10 is used, for example, as a tail lamp mounted on the rear of a vehicle. When mounted on the vehicle, the vehicle lamp 10 may extend over at least half of the vehicle width or substantially the entire vehicle width.

As illustrated in FIG. 2, the lamp unit 16 has a discharge protrusion 18 as a countermeasure against static electricity. FIG. 3 schematically illustrates a cross section of the vehicle lamp 10 in a plane perpendicular to the longitudinal direction X at a longitudinal position where the discharge protrusion 18 is disposed. Details of the discharge protrusion 18 will be described later.

The lamp unit 16 includes an upper extension member 20, a reflector member 22, a printed circuit board 25, an inner lens 28, and a lower extension member 30 as exemplary lamp components. These lamp components are elongated to extend along the longitudinal direction X.

For convenience of explanation, hereinafter, two directions orthogonal to each other in a plane perpendicular to the longitudinal direction X may be referred to as a transverse direction Y and a plate thickness direction Z. The lamp components have a thin plate shape elongated in the longitudinal direction X by way of non-limiting example. The lamp components may have a width and thickness which are significantly smaller than the length, and the thickness may be smaller than the width. In this case, the dimension in the longitudinal direction X is the length, the dimension in the transverse direction Y is the width, and the dimension in the plate thickness direction Z is the thickness.

The upper extension member 20 includes three upper extension segments 20*a*. Each upper extension segment 20*a* has a thin plate shape elongated in the longitudinal direction X. The upper extension segments 20*a* are arranged in the longitudinal direction X and are connected to each other.

The upper extension member 20, i.e., each upper extension segment 20*a* may be formed of, for example, a resin material, and may have a metal surface formed by vapor deposition of a metal material such as, for example, aluminum as needed. The resin material may be an appropriate general-purpose resin, and examples thereof include polycarbonate, polypropylene, acryl, acrylonitrile-styrene-acrylate (ASA), and acrylonitrile-butadiene-styrene (ABS). Such a resin member is manufactured, for example, by injection molding or any other appropriate molding method.

The reflector member 22 includes three reflector segments 22*a* arranged in the longitudinal direction X. Each reflector segment 22*a* has a thin plate shape elongated in the longitudinal direction X. The inner lens 28 is disposed in front of the reflector member 22 in the transverse direction Y. The reflector member 22 has a reflecting wall 23 on the rear side in the transverse direction Y so as to face the inner lens 28. Further, the reflector member 22 also has an opening 24 in a plate-shaped portion which connects the reflecting wall 23 to the inner lens 28. The opening 24 penetrates the reflector member 22 in the thickness direction Z.

The reflector member 22 is, for example, a white member formed of a resin. Alternatively, the reflector member 22 may have a resin body and a metal surface, as in the extension member.

The printed circuit board 25 is elongated to extend in the longitudinal direction X, is disposed on the lower surface of the reflector member 22, and is fixed by an appropriate method, for example, caulking. The printed circuit board 25 may be divided into a plurality of boards, which may be arranged in the longitudinal direction X, as in other long members.

A plurality of light emitting elements 26 are mounted on the printed circuit board 25. The plurality of light emitting elements 26 are mounted, for example, on the upper surface of the printed circuit board 25 and are aligned in the longitudinal direction X. As described above, since FIG. 3 schematically illustrates a cross section perpendicular to the longitudinal direction X, one of the plurality of light emitting elements 26 is illustrated. The light emitting element 26 is, for example, an LED element or any other semiconductor light emitting element.

The printed circuit board 25 has a wiring pattern formed of, for example, copper or any other metal for the power supply and the control of the light emitting element 26, and the wiring pattern includes a ground pattern 27. The wiring pattern is formed on one surface or both surfaces of the printed circuit board 25, and the ground pattern 27 is formed, for example, on the same surface as the light emitting element 26.

The ground pattern 27 is electrically connected to a ground potential (e.g., a body earth). The ground pattern 27 is grounded by an arbitrary method. For example, the ground pattern 27 may be connected from a connector portion of the printed circuit board 25 to the ground potential via a wiring cable. Alternatively, the ground pattern 27 may be grounded via an earth cord.

In general, the surface of the printed circuit board 25 is coated with an insulating film, so that the wiring pattern (including the ground pattern) is covered with the insulating film. However, at least a portion of the insulating film on the ground pattern 27 (e.g., a portion close to the discharge protrusion 18) may be peeled off to expose the ground pattern 27 below thereof. Thus, discharge from the discharge protrusion 18 to the ground pattern 27 may be promoted.

The inner lens 28 is formed as a single linear long member extending in the longitudinal direction X. The three reflector segments 22*a* are fixed to the rear side of the inner lens 28 in the transverse direction Y by an appropriate method, for example, lance coupling. The inner lens 28 is formed of a translucent resin or glass, for example.

The lower extension member 30 includes two lower extension segments 30*a*. The lower extension segments 30*a* are arranged in the longitudinal direction X and are connected to each other. Each lower extension segment 30*a* has a thin plate shape elongated in the longitudinal direction X. The lower extension segment 30*a* has a recess in a middle portion in the transverse direction Y. However, the lower extension member 30 is not limited to such a specific shape.

The number of segments constituting one lamp component may not be necessarily two or three, but may be any number. That is, the lamp component may include, for example, four or more segments arranged in the longitudinal direction X. Further, although the respective segments are illustrated in FIG. 2 as having substantially the same length and shape, this may not be essential. The individual segments constituting one lamp component may have different lengths and/or shapes. Alternatively, one lamp component may be configured as a single long component.

The printed circuit board 25 and the inner lens 28 are attached to the reflector member 22, and this assembly is vertically sandwiched between the upper extension member 20 and the lower extension member 30 to constitute the lamp unit 16. The upper extension member 20, the lower extension member 30, and the reflector member 22 are fixed to each other by an appropriate method, for example, screwing.

As illustrated in FIGS. 2 and 3, the lower extension member 30, i.e., each lower extension segment 30*a* includes a base 32 and a conductive surface 34. The base 32 is an insulating member, and is formed of, for example, an insulating material such as a resin material.

The conductive surface 34 is provided on at least a portion of the surface of the base 32. The conductive surface 34 is formed of a metal such as, for example, aluminum or any other conductive material. The conductive surface 34 may be provided on the surface of the base 32 by a variety of methods. The conductive surface 34 may be formed on the surface of the base 32 by, for example, vapor deposition, plating, or any other deposition method. The conductive surface 34 may be formed on the surface of the base 32 by adhering a foil formed of conductive material to the surface of the base 32. Alternatively, the conductive surface 34 may be formed on the surface of the base 32 by mounting a component formed of a conductive material on the surface of the base 32.

The conductive surface 34 has a strip-shaped portion 34*a* and a protrusion covering portion 34*b*. The strip-shaped portion 34*a* extends in the longitudinal direction X on the surface of the base 32. In a case of the lower extension member 30, the strip-shaped portion 34*a* is disposed, for example, on the front edge of the base 32. The protrusion covering portion 34*b* extends, for example, in the transverse direction Y along the surface of the base 32 from the strip-shaped portion 34*a* to cover the discharge protrusion 18. The strip-shaped portion 34*a* and the protrusion covering portion 34*b* are continuous and are electrically connected to each other. The strip-shaped portion 34*a* and the protrusion covering portion 34*b* may be formed on the surface of the base 32 at the same time by the same method, for example, vapor deposition. Alternatively, the strip-shaped portion 34*a* and the protrusion covering portion 34*b* may be separately formed by different methods. For example, the strip-shaped portion 34*a* may be formed by vapor deposition, and the protrusion covering portion 34*b* may be formed by adhesion of an aluminum foil.

The discharge protrusion 18 is disposed on the base 32 and is covered by the conductive surface 34. For example, a convex portion having a conical shape or any other shape is formed on the base 32, and the convex portion is covered by the conductive surface 34. The discharge protrusion 18 is located away from the strip-shaped portion 34*a*, and therefore, is covered by the protrusion covering portion 34*b* as described above.

The arrangement position of the discharge protrusion 18 is selected so as to be closer to the ground pattern 27 than the light emitting element 26. However, the discharge protrusion 18 and the ground pattern 27 do not come into physical contact with each other, and therefore, the discharge protrusion 18 and the ground pattern 27 are not electrically connected to each other. In the illustrated example, since the light emitting element 26 and the ground pattern 27 are disposed respectively at a front position and a rear position on the printed circuit board 25, the discharge protrusion 18 is also disposed at a rear position on the base 32. Further, the discharge protrusion 18 is disposed on the same side as the ground pattern 27 with respect to the printed circuit board 25. In the illustrated example, since the ground pattern 27 is provided on the upper surface of the printed circuit board 25, the discharge protrusion 18 is also on the upper side of the base 32.

At least one discharge protrusion 18 is provided for one member having the conductive surface 34. Because each lower extension segment 30*a* has a conductive surface 34, the discharge protrusion 18 is provided on each lower extension segment 30*a*. A plurality of discharge protrusions 18 may be provided on one member, and the discharge protrusions 18 are disposed close to each other and are covered by the protrusion covering portion 34*b*.

The discharge protrusion 18 has an arbitrary shape. The discharge protrusion 18 may have, for example, a conical shape, a pyramidal shape, or any other shape having a pointed tip as described above. Alternatively, the discharge protrusion 18 may have a cylindrical shape, a prismatic shape, a hemispherical shape, or any other shape. The discharge protrusion 18 may not necessarily be a point-shaped protrusion, and may be a linear protrusion extending in the longitudinal direction X, in the transverse direction Y, or in any other direction as needed.

While the vehicle lamp 10 is turned on, some of the light emitted from the light emitting element 26 arranged on the printed circuit board 25 strikes the reflecting wall 23 through the opening 24 in the reflector member 22. The light is reflected by the reflecting wall 23 and passes through the inner lens 28. The light emitted from the inner lens 28 is emitted out of the lamp through the translucent cover 14. In FIG. 3, an example of an optical path from the light emitting element 26 to the outside of the lamp is indicated by the arrow L.

As described above, the lamp components may be charged during driving of the vehicle. The translucent cover 14 is charged by friction with wind or sandy dust, for example, and an electric field is generated inside the vehicle lamp 10 due to the potential difference between the translucent cover and a vehicle body. For example, the lower extension member 30 may also be charged by electrostatic polarization. Since the lower extension member 30 is long and the conductive surface 34 has a relatively large area, a large amount of charge tends to be accumulated. Therefore, when electrostatic discharge occurs, this tends to cause a large amount of current. When the light emitting element 26 is discharged, a failure or some adverse effects may occur, but it is desirable to avoid such a situation.

According to the present embodiment, the lower extension member 30 is provided with the discharge protrusion 18. The discharge protrusion 18 is used as a discharge starting point. Since the discharge protrusion 18 is closer to the ground pattern 27 than the light emitting element 26, even if electrostatic discharge occurs, the discharge is likely to be directed to the ground pattern 27 and the risk of discharge to the light emitting element 26 is reduced. In this way, the light emitting element 26 may be protected from electrostatic discharge.

Since the discharge protrusion 18 is covered by the conductive surface 34, all or most of the charge accumulated on the conductive surface 34 is released once the discharge occurs, whereby charging of the lamp component having the conductive surface 34 may be eliminated or reduced. Since the conductive surface 34 has the strip-shaped portion 34*a* and the protrusion covering portion 34*b* electrically connected to each other, charging of not only the protrusion covering portion 34*b* but also the strip-shaped portion 34*a* may be eliminated or reduced.

Further, the discharge protrusion 18 is formed, for example, on the lamp component disposed close to the printed circuit board 25 like the lower extension member 30. By forming the discharge protrusion 18 on a member different from the printed circuit board 25, an existing product may be used for the printed circuit board 25 itself. There is no need to change the design of the printed circuit board 25 for a countermeasure against static electricity, and it is easy to form the discharge protrusion 18. Thus, it is expected that the vehicle lamp 10 with a countermeasure against static electricity may be provided at low cost.

Figure 4:
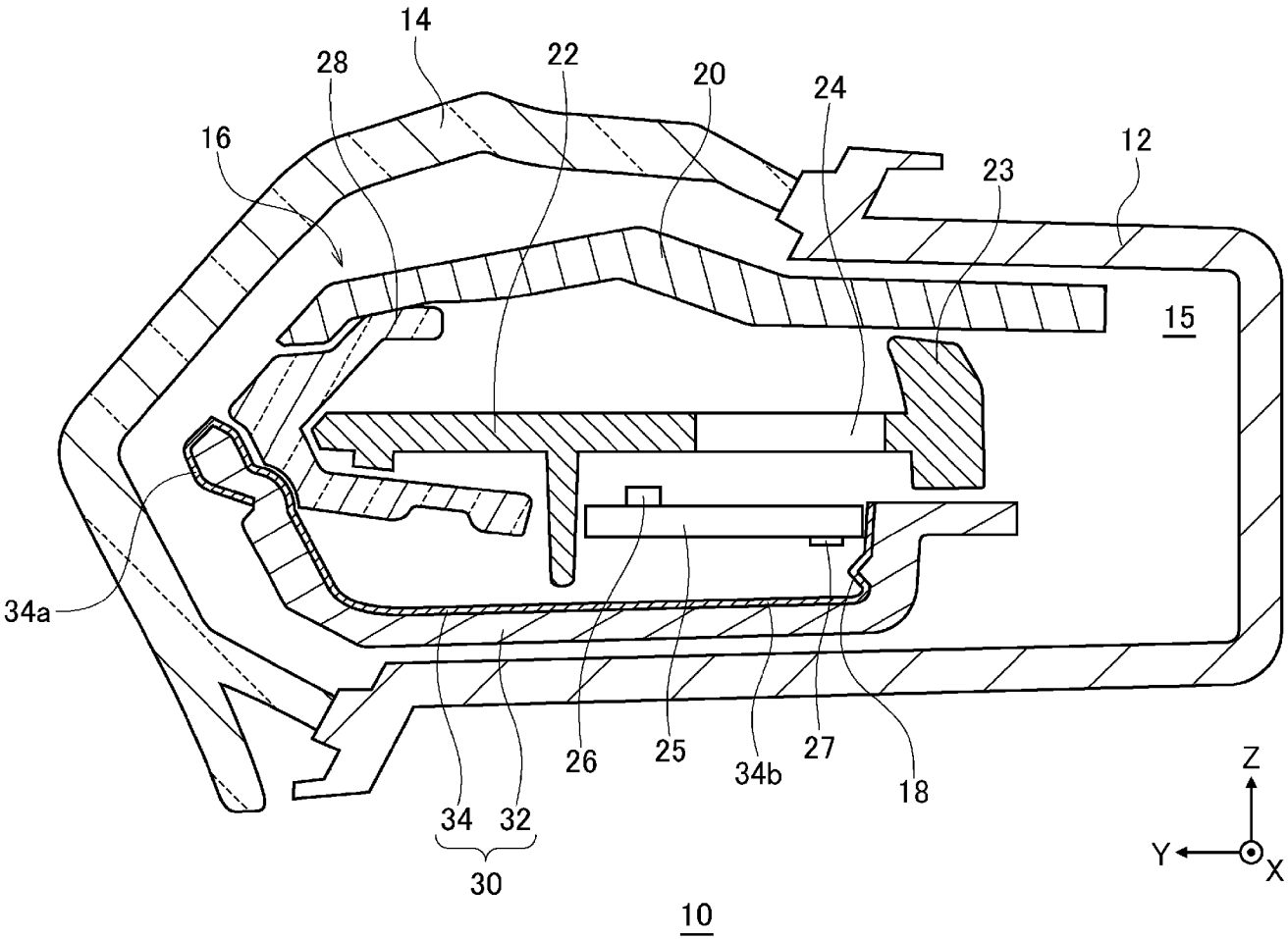
FIG. 4 is a schematic cross-sectional view of another example of the vehicle lamp according to the embodiment.

FIG. 4 is a schematic cross-sectional view of another example of the vehicle lamp according to the embodiment. As illustrated, depending on the design of the printed circuit board 25, the ground pattern 27 may be formed on a surface opposite to the surface on which the light emitting element 26 is mounted. Since the ground pattern 27 is provided on the lower surface of the printed circuit board 25, the discharge protrusion 18 is also disposed on the same surface as the ground pattern 27, i.e., on the lower side of the printed circuit board 25. Even in this case, the discharge protrusion 18 is disposed on the base 32 so as to be closer to the ground pattern 27 than the light emitting element 26, as in the above-described embodiment.

Figure 5:
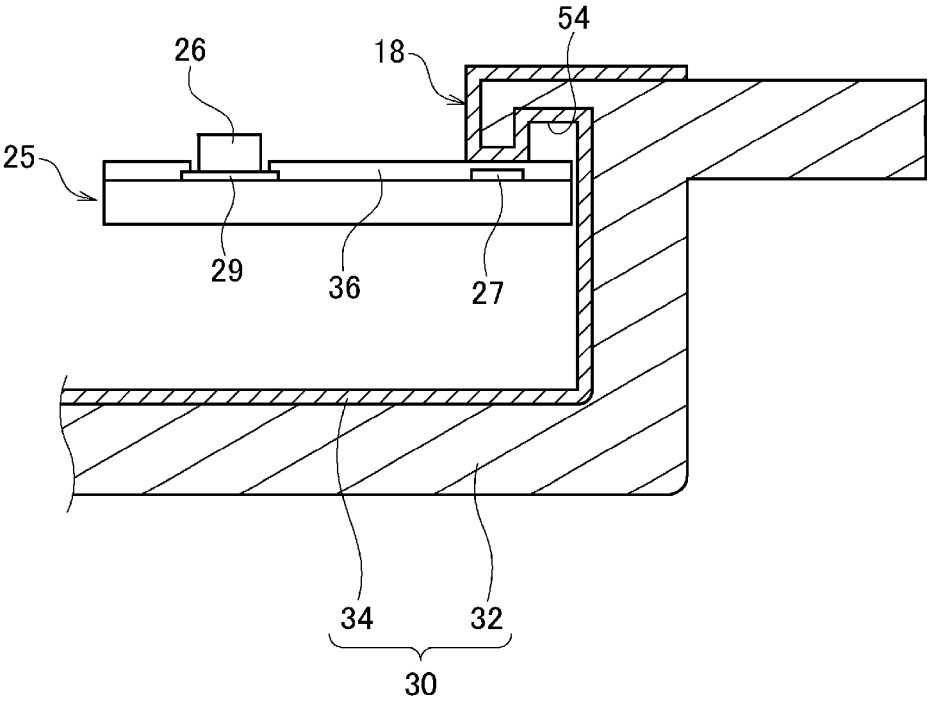
FIG. 5 is a schematic view illustrating a countermeasure structure against static electricity according to another embodiment.

FIG. 5 is a schematic view illustrating a countermeasure structure against static electricity according to another embodiment. For example, the lower extension member 30 or any other lamp component may include the base 32 formed of an insulating member, the conductive surface 34 provided on at least a portion of the surface of the base 32, and the discharge protrusion 18 as in the embodiment described with reference to FIGS. 1 to 4. The discharge protrusion 18 is disposed on the base 32 so as to be closer to the ground pattern 27 than the light emitting element 26 and is covered by the conductive surface 34.

The printed circuit board 25 mounts the light emitting element 26 thereon and includes the ground pattern 27 on the same surface as the light emitting element 26. The printed circuit board 25 includes an insulating layer 36 covering the ground pattern 27. Power is supplied to the light emitting element 26 from a wiring pattern 29. In addition, the ground pattern 27 and the insulating layer 36 may be formed on the surface opposite to the light emitting element 26. The insulating layer 36 may be, for example, an insulating film as a surface coating of the printed circuit board 25.

The discharge protrusion 18 comes into physical contact with the printed circuit board 25 so as to sandwich the insulating layer 36 between the discharge protrusion 18 and the ground pattern 27. Since the insulating layer 36 is interposed, the discharge protrusion 18 is not electrically connected to the ground pattern 27. In addition, the discharge protrusion 18 may be disposed with a gap (e.g., a gap of several mm or less although a discharge start voltage depends on the shape of an electrode) from the insulating layer 36 so as to sandwich the insulating layer 36 between the discharge protrusion 18 and the ground pattern 27, instead of coming into physical contact with the printed circuit board 25.

In this way, since the discharge protrusion 18 is disposed very close to the ground pattern 27, discharge from the discharge protrusion 18 to the ground pattern 27 is likely to occur. The risk of discharge to the light emitting element 26 may be significantly reduced, and the light emitting element 26 may be protected more reliably from electrostatic discharge. Even in this case, an existing product may be used for the printed circuit board 25 itself, and therefore, the vehicle lamp 10 with a countermeasure against static electricity may be provided without significantly increasing the manufacturing cost.

Figure 6A:
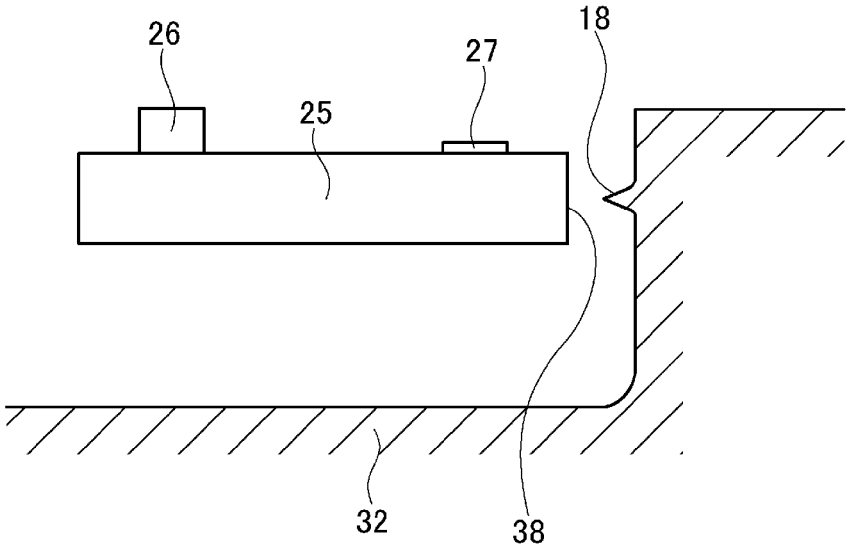
FIGS. 6A and 6B are schematic views illustrating countermeasure structures against static electricity according to other embodiments.
Figure 6B:
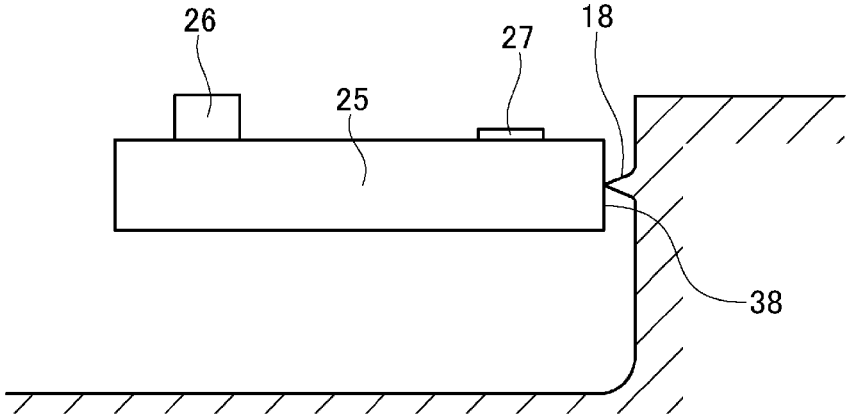

FIGS. 6A and 6B are schematic views illustrating countermeasure structures against static electricity according to other embodiments. Since a base material of the printed circuit board 25 is formed of an insulating material, a side surface 38 of the printed circuit board 25 is an insulating surface. As illustrated in FIG. 6A, the discharge protrusion 18 may face the insulating side surface 38 of the printed circuit board 25. As illustrated in FIG. 6B, the discharge protrusion 18 may come into physical contact with the insulating side surface 38 of the printed circuit board 25. The illustrated side surface 38 is one of several side surfaces (e.g., four side surfaces in a case of a rectangular printed circuit board) of the printed circuit board 25 and is closest to the ground pattern 27. Since the discharge protrusion 18 only faces or comes into contact with the insulating side surface 38, the discharge protrusion is not electrically connected to the ground pattern 27.

Even in this case, since the discharge protrusion 18 is disposed closer to the ground pattern 27 than the light emitting element 26, discharge from the discharge protrusion 18 to the ground pattern 27 is likely to occur. The risk of discharge to the light emitting element 26 may be reduced, and the light emitting element 26 may be protected from electrostatic discharge. Even in this case, an existing product may be used for the printed circuit board 25 itself, and therefore, the vehicle lamp 10 which is protected against static electricity may be provided without significantly increasing the manufacturing cost.

Figure 7A:
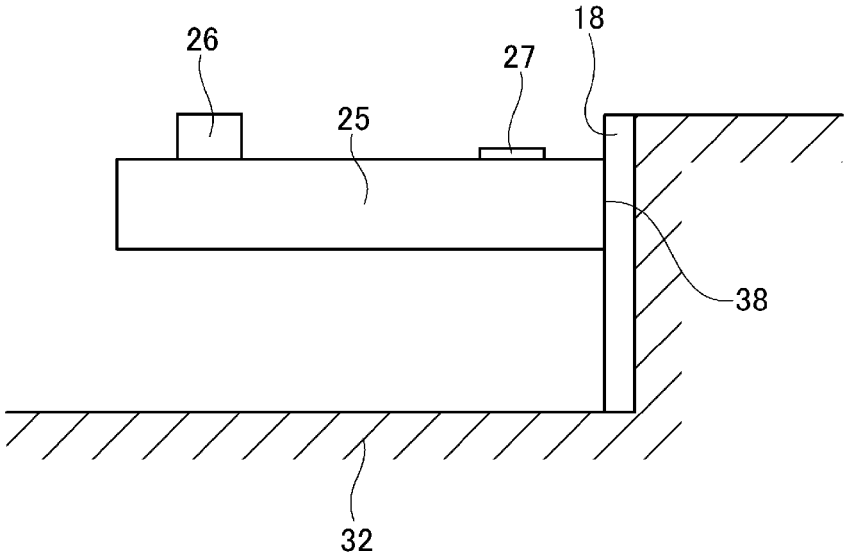
FIGS. 7A and 7B illustrate a modification of the embodiment illustrated in FIG. 6B.
Figure 7B:
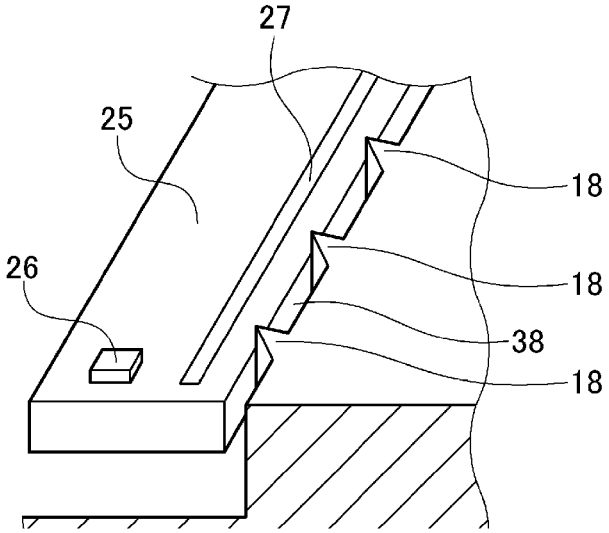

In the above-described embodiment, the discharge protrusion 18 is formed as a point-shaped protrusion, but this may not be essential. FIGS. 7A and 7B illustrate a modification of the embodiment illustrated in FIG. 6B. FIG. 7B is a schematic perspective view of a countermeasure structure against static electricity illustrated in FIG. 7A. The discharge protrusion 18 may be a linear protrusion formed on the base 32. As illustrated, the discharge protrusion 18 is elongated to extend, for example, along the vertical direction from the bottom surface of the base 32. In this way, since it is possible to avoid the undercut of the discharge protrusion 18 in a molding process of the base 32, it is possible to reduce the manufacturing cost of a mold. In addition, the discharge protrusion 18 may have any other arrangement and shape. The discharge protrusion 18 may be a linear protrusion elongated to extend in an arbitrary direction from other wall surfaces of the base 32. Further, the cross section perpendicular to the direction in which the protrusion extends is not limited to the illustrated triangular shape, and may have a polygonal shape such as a trapezoidal shape, any other polygonal shape, a curved shape such as a semicircular shape, or any other arbitrary shape.

Figure 8:
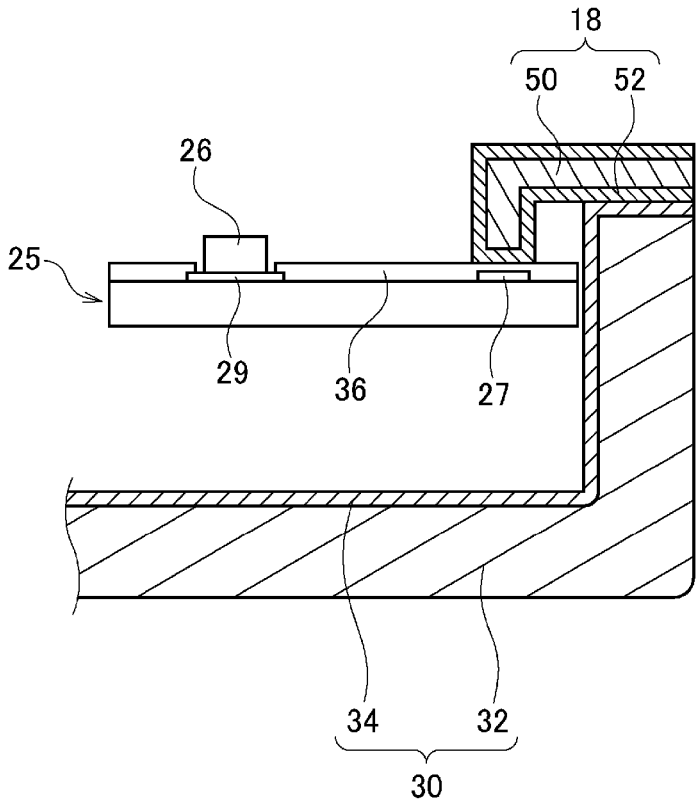
FIG. 8 illustrates a modification of the embodiment illustrated in FIG. 5.

In the above-described embodiment, the discharge protrusion 18 is disposed on the base 32 as a convex portion formed on the base 32 and is covered by the conductive surface 34. However, it may not be essential that the discharge protrusion 18 includes a convex portion formed on the base 32. FIG. 8 illustrates a modification of the embodiment illustrated in FIG. 5. As illustrated in FIG. 8, the discharge protrusion 18 may be prepared as a member separate from the base 32 and may be disposed on the base 32 by being mounted on the base 32. In this case, the discharge protrusion 18 may include an insulating protrusion body 50 and a conductive layer 52 covering the protrusion body 50. When the discharge protrusion 18 is disposed on the base 32, the conductive layer 52 comes into contact with the conductive surface 34 on the base 32 and is electrically connected thereto. Alternatively, the discharge protrusion 18 may be entirely formed of a conductive material. Even in these cases, the discharge protrusion 18 is considered to be disposed on the base 32 and be covered by the conductive surface 34.

The modification illustrated in FIG. 8 is advantageous due to the following fact compared to the embodiment illustrated in FIG. 5. In FIG. 5, the base 32 has a recess 54 adjacent to the discharge protrusion 18. Both the discharge protrusion 18 and the recess 54 are covered by the conductive surface 34. When using a typical method such as vapor deposition, it is more difficult to satisfactorily form a conductive film in the recess 54 than on a convex portion and a flat surface. In the modification illustrated in FIG. 8, the recess 54 may be eliminated by using the discharge protrusion 18 as a separate member. That is, a process of forming the conductive layer 52 on the protrusion body 50 of the discharge protrusion 18 and a process of forming the conductive surface 34 on the base 32 may be performed separately. The conductive surface 34 and the conductive layer 52 may be formed with stable quality, and the discharge protrusion 18 and the conductive surface 34 may be electrically connected more reliably.

In the above-described embodiment, the discharge protrusion 18 is formed on the lower extension member 30, but the disclosure is not limited thereto. The discharge protrusion 18 may be disposed on the base of the upper extension member 20 or any other design member having a conductive surface and may be covered by the conductive surface. The discharge protrusion 18 may be disposed on the base of an optical member or any other lamp component having a conductive surface and may be covered by the conductive surface. In either case, the discharge protrusion 18 is disposed on the base of the lamp component so as to be closer to the ground pattern 27 than the light emitting element 26. In this way, a vehicle lamp with a countermeasure against static electricity may be provided.

In the above-described embodiment, although a case where the vehicle lamp 10 is a tail lamp has been described by way of example, the vehicle lamp 10 is not limited to this specific example. The vehicle lamp 10 may be any other marker lamp such as a turn signal lamp, a stop lamp, a clearance lamp, or daytime running lamp or any other vehicle lamp.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle lamp comprising:

a lamp body;

a translucent cover combined with the lamp body to form a lamp chamber in between;

a printed circuit board disposed in the lamp chamber and including a light emitting source mounted thereon and a ground pattern provided on the same surface as or a surface opposite to the light emitting source; and a lamp component disposed in the lamp chamber and including a base formed of an insulator, a conductive surface provided on at least a portion of a surface of the base, and a discharge protrusion disposed on the base so as to be closer to the ground pattern than the light emitting source and covered by the conductive surface.

2. The vehicle lamp according to claim 1, wherein the printed circuit board includes an insulating layer that covers the ground pattern, and the discharge protrusion comes into physical contact with the printed circuit board so as to sandwich the insulating layer between the discharge protrusion and the ground pattern.

3. The vehicle lamp according to claim 1, wherein the discharge protrusion faces an insulating side surface of the printed circuit board or comes into physical contact with the insulating side surface of the printed circuit board.

* * * * *